US005931554A

United States Patent [19]

Koopman

[11] Patent Number: 5,931,554

[45] Date of Patent: Aug. 3, 1999

[54] REFRIGERATOR DOOR STOP

[75] Inventor: Charles Henry Koopman, Louisville, Ky.

[73] Assignee: General Electric Company, Louisville, Ky.

[21] Appl. No.: 08/980,983

[22] Filed: Aug. 29, 1997

[51] Int. Cl.[6] ..... E05F 1/08

[52] U.S. Cl. ..... 312/405; 312/319.2; 16/357; 16/286

[58] Field of Search ..... 312/325, 326, 312/329, 401, 405, 319.2; 16/357, 286; 49/399, 109

[56] References Cited

U.S. PATENT DOCUMENTS

| | | | |
|---|---|---|---|
| 2,189,818 | 2/1940 | Murrin . | |
| 3,686,804 | 8/1972 | Browne | 52/31 |
| 4,440,459 | 4/1984 | Hallgren | 312/238 |
| 4,609,234 | 9/1986 | Naniwa et al. | 312/296 |
| 4,690,468 | 9/1987 | Lau . | |
| 5,027,473 | 7/1991 | Hottmann | 16/286 |
| 5,265,954 | 11/1993 | Keil | 312/405 |
| 5,272,789 | 12/1993 | Mitchell et al. . | |
| 5,465,557 | 11/1995 | Harte | 16/357 X |
| 5,497,534 | 3/1996 | Caruso . | |
| 5,522,656 | 6/1996 | Jenkins | 312/405 X |

*Primary Examiner*—Peter M. Cuomo
*Assistant Examiner*—Janet M. Wilkens
*Attorney, Agent, or Firm*—H. Neil Houser

[57] ABSTRACT

A hinge and closure mechanism with an integral door stop which, together with the closure unit of the mechanism, stops a refrigerator door from opening beyond a preselected position is described. In one embodiment, the mechanism includes a hinge unit, a closure unit, and door stop. The hinge unit includes a cabinet hinge plate and a door hinge plate. The cabinet hinge plate is mounted to the base of the cabinet, and the door hinge plate is mounted to a refrigerator door. A connector pin and a pivot pin extend through respective openings in the door hinge plate, and door hinge plate is coupled to the cabinet hinge plate by the pivot pin. The closure unit includes a pivot plate coupled to the door hinge plate by the connector pin. The closure unit also includes a compression spring and a link. The link couples the spring to the pivot plate. A pin stop slot is located in the pivot plate, and the dimensions of the slot are selected to correspond to the position at which it is desired to stop the refrigerator door. A pin stop extends through the pin stop slot and is engaged to the cabinet hinge plate. More particularly, the pin stop includes a flange which prevents the pin stop from extending completely through the pin stop slot. The pin stop also includes a bushing having a first portion and a second portion. The bushing first portion extends through slot for minimizing friction between the slot and the pin stop, and the bushing second portion has an end in contact with the cabinet hinge plate. The pin stop further includes a threaded end sized to be inserted into the pin stop opening in the cabinet hinge plate for being threadedly engaged to cabinet hinge plate. As the refrigerator door is opened, the pivot plate rotates with the door. When the pivot plate rotates to a point at which the pin stop is located at the far end of the slot, the pin stop abuts against the pivot plate and prevents further rotation of the door.

18 Claims, 3 Drawing Sheets

REFRIGERATOR DOOR STOP

FIELD OF THE INVENTION

This invention relates generally to household refrigerators and more particularly, to a door stop integral with a hinge and closure mechanism for a refrigerator door.

BACKGROUND OF THE INVENTION

Side-by-side household refrigerators include a fresh food storage compartment and a freezer storage compartment. Each storage compartment has a front access opening normally closed by a fresh food door and a freezer door, respectively. The doors are mounted to the cabinet by hinge mechanisms. With at least some known refrigerators, no positive stop is provided to prevent opening the door beyond a preselected position. For example, with some known refrigerators, the door can be rotated away from the refrigerator cabinet to a point at which the hinge mechanism itself prevents further rotation. In some house installations, the hinge mechanisms may not prevent rotation of the refrigerator door beyond a point at which the refrigerator door impacts against adjacent cabinets or walls of the house.

It would be desirable to provide a positive door stop which prevents opening a refrigerator door beyond a preselected position. It also would be desirable to provide such a positive door stop which is easy to assemble and does not add significant labor and material cost to the assembly of refrigerator hinge and closure mechanisms.

SUMMARY OF THE INVENTION

These and other objects may be attained by a hinge and closure mechanism with an integral door stop which, together with the closure unit of the mechanism, stops a refrigerator door from opening beyond a preselected position. The door stop is integral with the hinge and closure mechanism in that certain components of the mechanism also perform functions associated with the door stop. More particularly, the hinge unit includes a cabinet hinge plate and a door hinge plate. The cabinet hinge plate is mounted to the base of the cabinet, and the door hinge plate is mounted to a refrigerator door. A connector pin and a pivot pin extend through respective openings in the door hinge plate, and the door hinge plate is coupled to the cabinet hinge plate by the pivot pin. The closure unit includes a pivot plate coupled to the door hinge plate by the connector pin. The closure unit also includes a compression spring and a link. The link couples the spring to the pivot plate.

With respect to the door stop, a pin stop slot is located in the pivot plate, and the dimensions of the slot are selected to correspond to the position at which it is desired to stop the refrigerator door. A pin stop extends through the pin stop slot and is engaged to the cabinet hinge plate. More particularly, the pin stop includes a flange which prevents the pin stop from extending completely through the pin stop slot. The pin stop also includes a bushing having a first portion and a second portion. The bushing first portion extends through the slot for minimizing friction between the slot and the pin stop, and the bushing second portion has an end in contact with the cabinet hinge plate. The pin stop further includes a threaded end sized to be inserted into the pin stop opening and threadedly engaged to the cabinet hinge plate.

As the refrigerator door is opened, the pivot plate rotates with the door and the pin stop remains substantially stationary. When the pivot plate rotates to a point at which the pin stop is located at the end of the slot, the pin stop abuts against the pivot plate and prevents further rotation of the door. The length of the slot and the position of the pin stop can be selected to provide door stopping at a preselected position which typically is in a range of between about one hundred and twenty to one hundred and thirty five degrees open.

With the above described hinge and closure mechanism, door stopping is performed by the combination of the door stop and the closure unit. Specifically, as the door is opened, the spring is progressively compressed. As the spring is compressed, forces are transferred from the spring through the link to the pivot plate to resist further opening of the door. These forces, in combination with the door stop, act to stop the door when the pin stop abuts against the end of the slot. Therefore, door stopping is not fully dependent on the impact of the pin stop when it abuts against walls of the slot, and the impact forces of the pin stop against the pivot plate are believed to be less than the impact forces which would otherwise be generated if door stopping were fully dependent on the impact of the pin stop. Such reduced impact is believed to provide a number of advantages, including reducing the forces acting on items stored in door upon stopping.

In addition, the above described mechanism provides positive door stopping which facilitates preventing opening a refrigerator door beyond a preselected position which could cause damage to adjacent walls and cabinets. Such mechanism also is easy to assemble and does not add significant labor and material cost to the assembly of refrigerator hinge and closure mechanisms.

DETAILED DESCRIPTION

An exemplary embodiment of a door hinge and closure mechanism with an integral door stop in accordance with one embodiment of the present invention is described below in detail in connection with a side-by-side household refrigerator. Side-by-side household refrigerators are commercially available from General Electric Company, Louisville, Ky., 40225, and such refrigerators can be modified to incorporate the hinge and closure mechanism with the integral door stop. The hinge and closure mechanism with the integral door stop, of course, can be used in many other models and types of refrigerators, such as top mount refrigerators, other than the specific side-by-side refrigerator described herein.

Although a hinge and closure mechanism with an integral door stop is described herein as being coupled to the bottom of the cabinet, it should be understood that such mechanism could be coupled to the top of the cabinet. The manner of coupling the mechanism to the top of the cabinet will be apparent to those skilled in the art.

Figure 1:
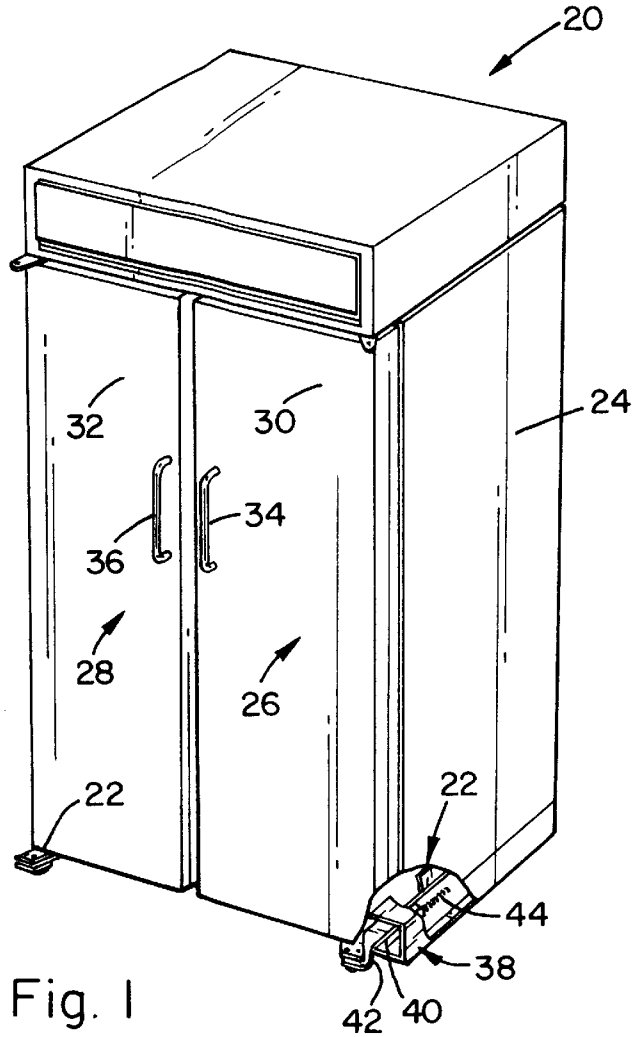
FIG. 1 is a perspective view of a side-by-side refrigerator including a door hinge and closure mechanism in accordance with one embodiment of the present invention.

Referring now specifically to the drawings, FIG. 1 is a perspective view of a side-by-side refrigerator 20 including hinge and closure mechanisms 22 (sometimes referred to herein as hinge mechanisms 22) in accordance with one embodiment of the present invention. Refrigerator 20 includes a cabinet 24 having a fresh food storage compartment 26 and a freezer storage compartment 28 arranged in a side-by-side configuration. Each storage compartment 26 and 28 has a front access opening normally closed by a fresh food door 30 and a freezer door 32, respectively. Each door 30 and 32 is secured to compartment cabinet 24 by hinge mechanisms 22, and handles 34 and 36 are mounted to each door 30 and 32 to facilitate door opening.

Refrigerator 20 includes a base 38 which forms a base channel 40. As described below in more detail, hinge and closure mechanisms 22 include a hinge unit 42 and a closure unit 44. Although only one mechanism 22 is described below in detail, it should be understood that the other hinge and closure mechanism utilized in connection with refrigerator 20 is identical to the described mechanism.

Figure 2:
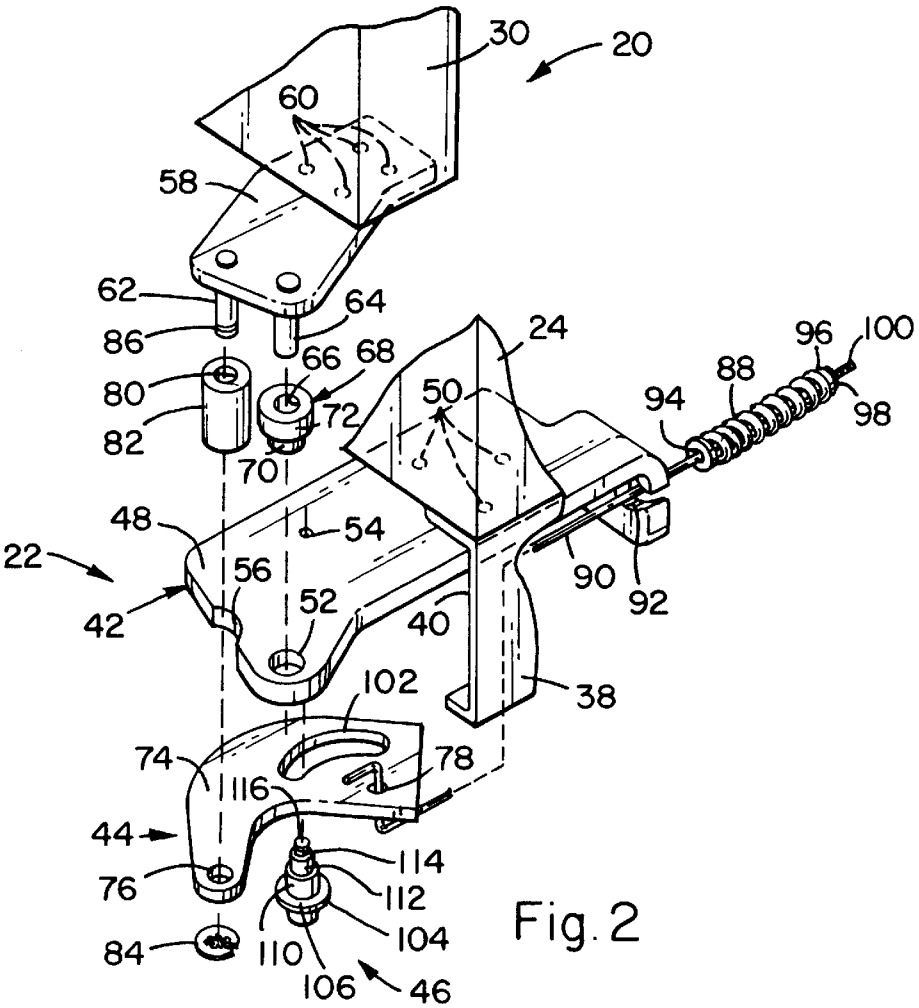
FIG. 2 is a perspective view of a portion of the refrigerator shown in FIG. 1 including the door hinge and closure mechanism with an integral door stop.

FIG. 2 is a perspective view of a portion of refrigerator 20 including door hinge and closure mechanism 22 with an integral door stop 46. Door stop 46 is integral with mechanism 22 in that certain components of mechanism 22 also perform functions associated with door stop 46. More particularly, hinge unit 42 includes a cabinet hinge plate 48 mounted to base 38 by screws 50. Cabinet hinge plate 48 includes a pivot pin opening 52, a pin stop opening 54, and a connector pin cutout 56. Hinge unit 42 also includes a door hinge plate 58 mounted to door 30 by screws 60. A connector pin 62 and a pivot pin 64 extend through respective openings in door hinge plate 58. Door hinge plate 58 is coupled to cabinet hinge plate 48 by pivot pin 64 which extends from door hinge plate 58 through a bore 66 in a bushing 68 and into pivot pin opening 52. Bushing 68 includes a first, smaller diameter portion 70 which is inserted into pivot pin opening 52 and a second, larger diameter portion 72 which prevents bushing 68 from falling through opening 52. Pivot pin bushing 68 is therefore trapped between door hinge plate 58 and cabinet hinge plate 48.

Closure unit 44 includes a pivot plate 74 having a connector pin opening 76 and a link opening 78. Door hinge plate 58 is coupled to pivot plate 74 by connector pin 62 which extends through a bore 80 of a bushing 82 and through opening 76 in pivot plate 74. A snap ring 84 snaps into a groove 86 of connector pin 62 and substantially prevents connector pin 62 from being lifted away from pivot plate 74. Bushing 82 is trapped between door hinge plate 58 and pivot plate 74.

Closure unit 44 also includes a compression spring 88 and a link 90. Link 90 couples spring 88 to pivot plate 74. More particularly, link 90 extends through opening 78 in pivot plate 74, through a slot 92 in hinge plate 48, and through compression spring 88. A first stop washer 94 is provided to prevent spring 88 from moving through slot 92, and a second stop washer 96 and load adjustment nut 98, which is threadedly engaged to a threaded end 100 of link 90, are provided so that the loading of spring 88 as it is compressed between stop washers 94 and 96 can be adjusted.

A pin stop slot 102 is located in pivot plate 74, and the dimensions of slot 102 are selected to correspond to the position at which it is desired to stop opening of door 30 as described below. A pin stop 104 extends through slot 102 and is engaged to cabinet hinge plate 48. More particularly, pin stop 104 includes a flange 106 which prevents pin stop 104 from extending completely through pin stop slot 102. Pin stop 104 also includes a bushing 108 which extends through slot 102 for minimizing friction between walls of slot 102 and pin stop 104 and for contacting the ends of slot 102. Bushing 108 has a first portion 110 and a second portion 112. Bushing first portion 110 extends through slot 102 for minimizing friction between slot 102 and pin stop 104 and for contacting the ends of slot 102, and bushing second portion 112 has an end 114 in contact with cabinet hinge plate 48. Pin stop 104 further includes a threaded end 116 sized to be inserted into pin stop opening 54 in cabinet hinge plate 48 for being threadedly engaged to cabinet hinge plate 48.

Figure 3:
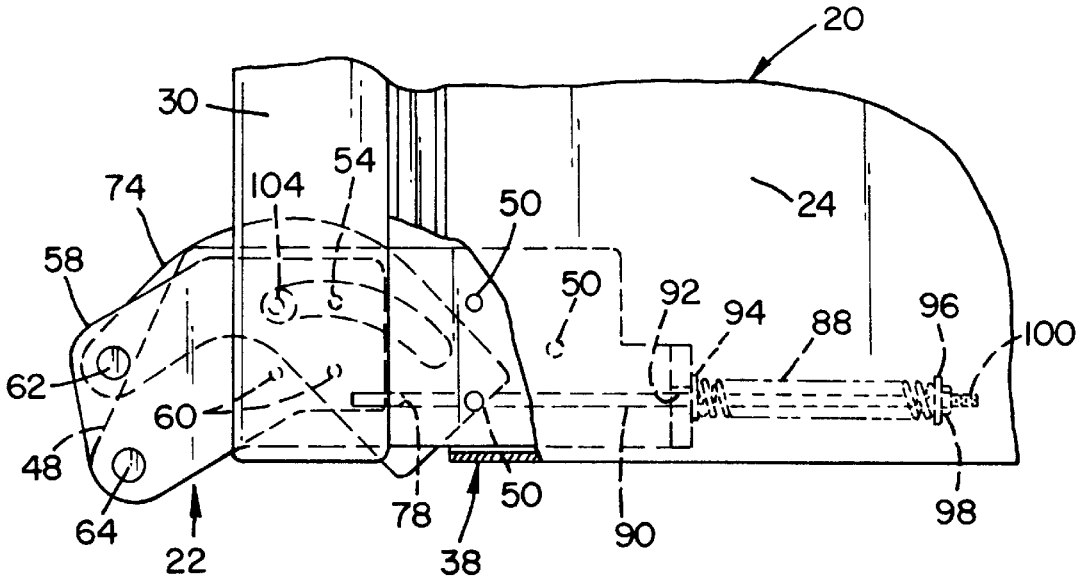
FIG. 3 is a top view of the door hinge and closure mechanism with the integral door stop shown in FIG. 2.

FIG. 3 is a top view of door hinge and closure mechanism 22. As shown in FIG. 3, pin stop 104 is located at one end of slot 102 when door 30 is closed. As door 30 is opened, pivot plate 74 rotates with door 30. When pin stop 104 reaches the far end of slot 102, then pin stop 104 abuts against pivot plate 74 and prevents further rotation of door 30. More particularly, and in the specific embodiment described above, when door 30 rotates to a preselected position, pin stop 104 abuts against the far end of slot 102 and prevents further opening of door 30. The length of slot 102 and the position of pin stop 104 can be selected to provide door stopping at a preselected position which typically is in a range of between about one hundred and twenty to one hundred and thirty five degrees open.

Figure 4:
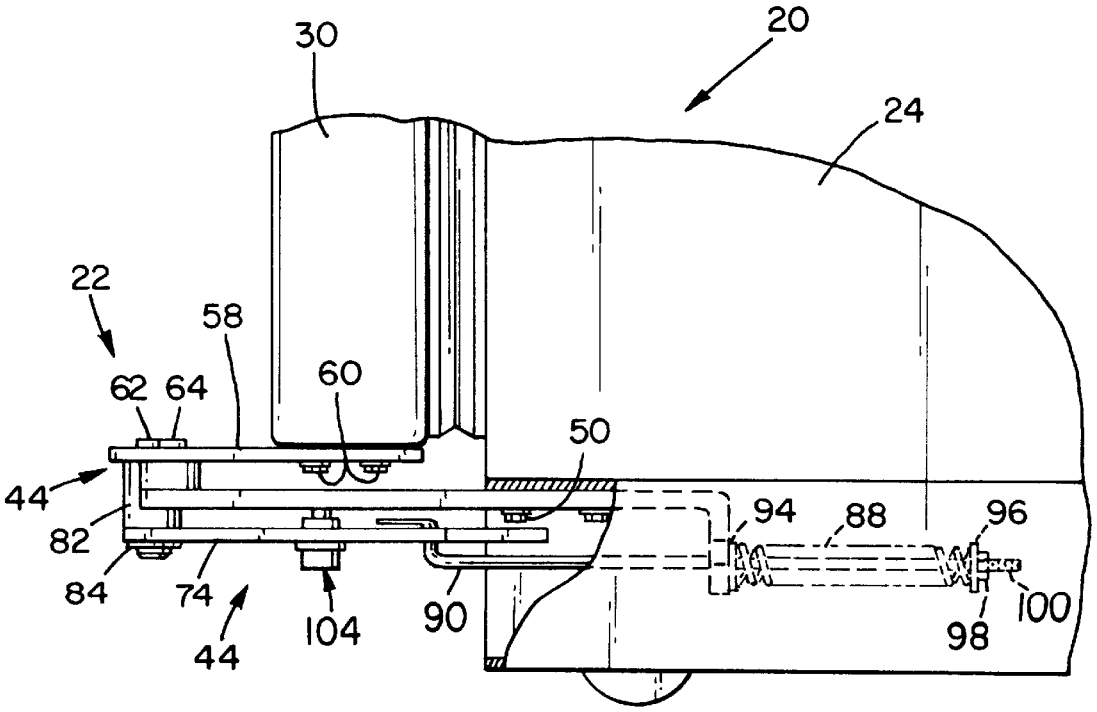
FIG. 4 is a side view of the door hinge and closure mechanism with the integral door stop shown in FIG. 2.

FIG. 4 is a side view of door hinge and closure mechanism 22. As shown in FIG. 4, the extent to which mechanism 22 extends beyond door 30 is minimal, which enhances the aesthetic appearance of refrigerator 22. Spring 88 may, for example, be fabricated from spring steel. Link 90 may be a flexible wire such as cable. Door hinge plate 58, cabinet hinge plate 48, and pivot plate 74 may be fabricated from 1045 carbon steel, for example. Of course, the components of mechanism 22 may be fabricated from many other materials.

Figure 5:
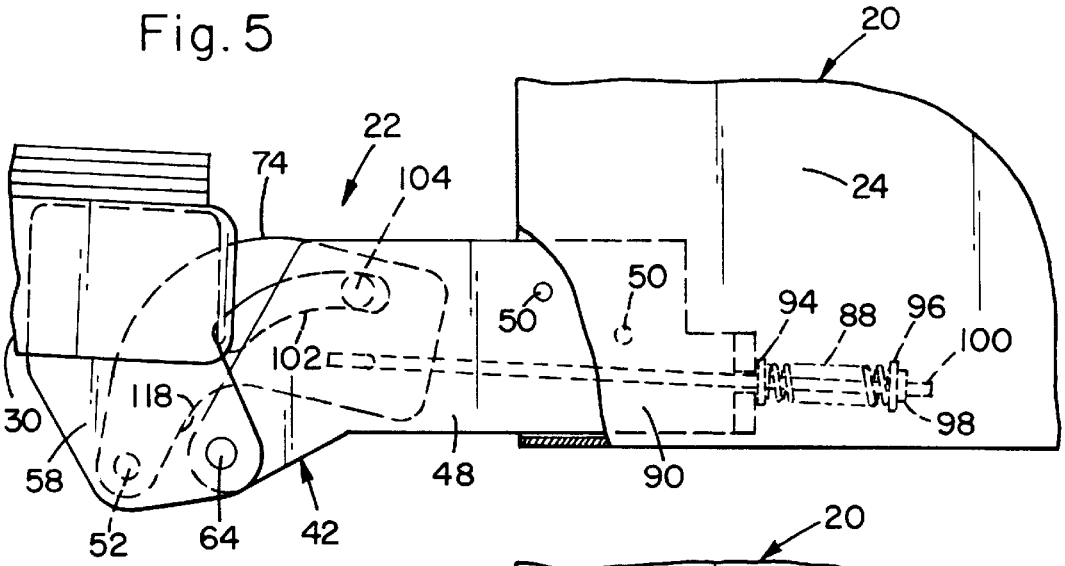
FIG. 5 is a top view of the door hinge and closure mechanism with the integral door stop with the door open to about ninety degrees.

FIG. 5 is a top view of the door hinge and closure mechanism 22 with door 30 open to about ninety degrees. In this position, spring 88 is more compressed as compared to the compression of spring 88 in when door 30 is in the fully closed position (FIG. 3). Also, pivot plate 74 substantially freely rotates to this position in that pin stop 104 and pivot pin bushing 68 do not interfere with rotation of plate 74. Spring 88, of course, exerts a closure force on door 30 through plate 74 as door 30 is opened.

Figure 6:
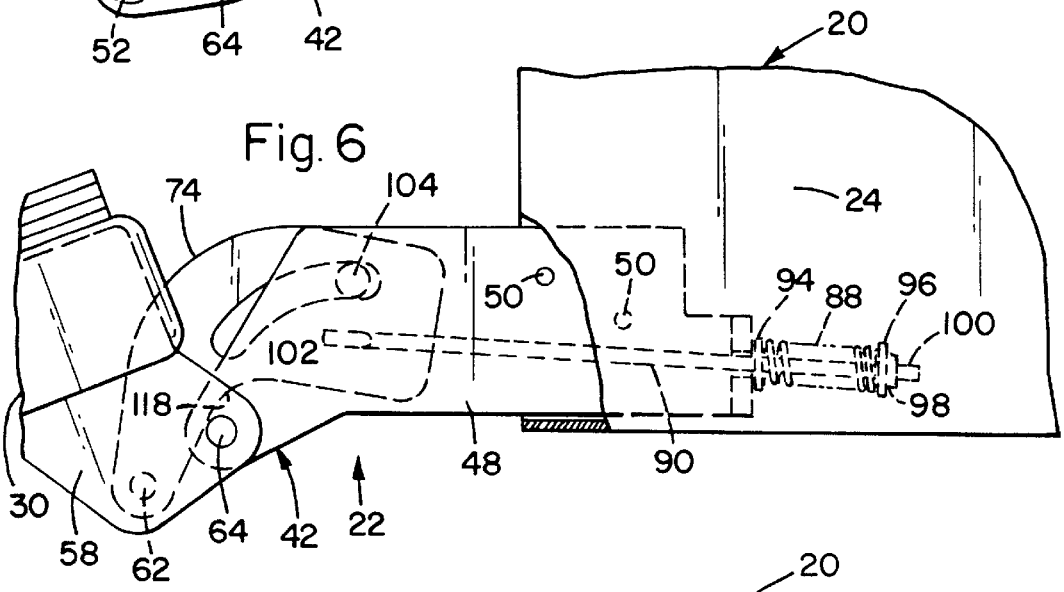
FIG. 6 is a top view of the door hinge and closure mechanism with the integral door stop with the door opened beyond ninety degrees.

FIG. 6 is a top view of door hinge and closure mechanism 22 with door 30 opened beyond ninety degrees. In the position shown in FIG. 6, pivot plate 74 is in contact with pivot pin bushing 68 at pivot pin 64. Particularly, a side surface 118 of pivot plate 74 is shaped, i.e., curved, so that pivot plate 74 does not prevent rotation of door 30 yet contacts bushing 68. Such contact results in friction forces between plate 74 and bushing 68. In addition, spring 88 is progressively compressed as door 30 is rotated from the position shown in FIG. 5 to the position shown in FIG. 6. The closure forces generated by spring 88 and the friction forces between plate 74 and bushing 68 decelerate door 30 and act as a deterrent to further opening of door 30. Pin stop 104, however, is still located at an intermediate location within slot 102 and door 30 can be opened further.

Figure 7:
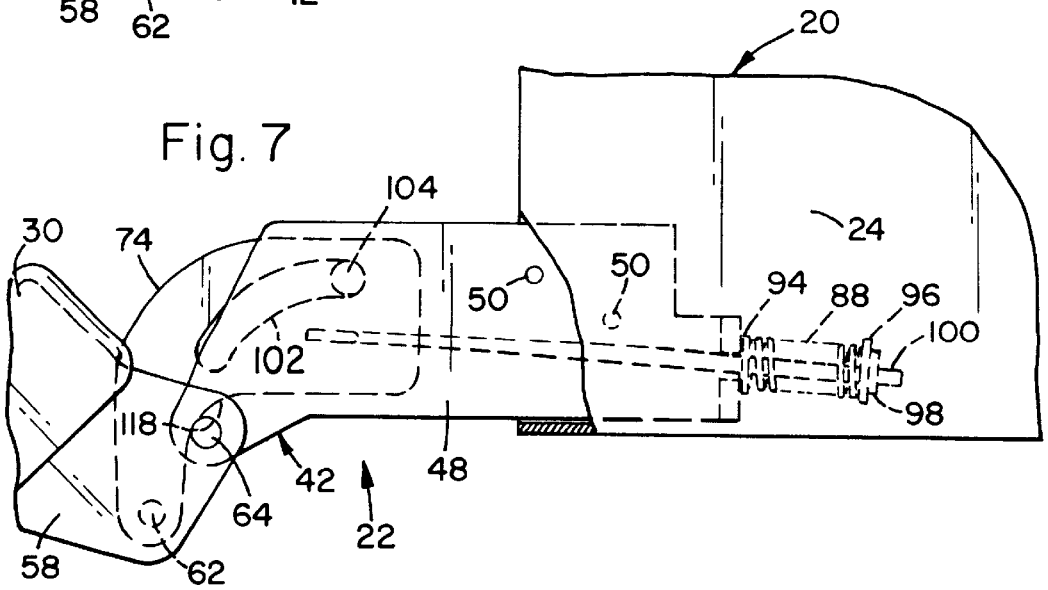
FIG. 7 is a top view of the door hinge and closure mechanism with the integral door stop with the door opened to the full open position.

FIG. 7 is a top view of door hinge and closure mechanism 22 with door 30 opened to the full open position. In the full open position, pin stop 104 abuts against the end of slot 102 and prevents further opening, or rotation, of door 30. Door stopping, however, is not fully dependent upon the impact of pin stop 104 against the end of slot 102. Specifically, the closure forces generated by spring 88 and the friction between plate 74 and bushing 68 decelerate door 30 before door 30 reaches the fully open position.

With integral door stop and closure mechanism 22, door stopping is performed by the combination of door stop 46 and closure unit 44. Specifically, as door 30 is opened, compression spring 88 generates forces which are transferred through link 90 to pivot plate 74 to resist further opening of door 30. When door 30 is opened beyond the ninety degree opened position, pivot plate 74 contacts pivot pin bushing 68. The closure forces generated by spring 88 and the friction forces between plate 74 and bushing 68 decelerate door 30 and act as a deterrent to further opening of door 30. These forces, in combination with door stop 46, act to stop door 30 when pin stop 104 abuts against the far end of slot 102. Therefore, with mechanism 22, door stopping is not fully dependent on the impact of pin stop 104 when it abuts against walls of slot 102. The impact forces of pin stop 104 against pivot plate 74 are believed to be less than the impact forces which would otherwise be generated if door stopping were fully dependent on the impact of pin stop 104 against plate 74. Such reduced impact is believed to provide a number of advantages, including reducing the forces acting on items stored in door 30 upon stopping.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A refrigerator comprising a cabinet having at least one access opening closed by a door, said door coupled to said cabinet by a hinge and closure mechanism, said mechanism comprising:

a hinge unit comprising a door hinge plate mounted to said door and a cabinet hinge plate mounted to said cabinet, said door hinge plate coupled to said cabinet hinge plate, said cabinet hinge plate having a pin stop opening therein;

a closure unit for exerting a closure force on said door, said closure unit comprising a pivot plate coupled to said door hinge plate, said pivot plate having a pin stop slot therein, a spring movably coupled to said pivot plate, and a link coupling said spring to said pivot plate; and a pin stop for assisting in stopping opening of said door, said pin stop extending through said pin stop slot in said pivot plate and into said pin stop opening in said cabinet hinge plate.

2. A refrigerator in accordance with claim 1 wherein said hinge unit further comprises a pivot pin coupled to and extending from said door hinge plate, a pivot pin opening in said cabinet hinge plate, said pivot pin extending into said pivot pin opening in said cabinet hinge plate, and a pivot pin bushing having a bore therethrough, said pivot pin extending through said pivot pin bushing and said pivot pin bushing being trapped between said door hinge plate and said cabinet hinge plate.

3. A refrigerator in accordance with claim 1 wherein said hinge unit further comprises a connector pin coupled to and extending from said door hinge plate, a connector pin opening in said pivot plate, said connector pin extending through said connector pin opening in said pivot plate, and a connector pin bushing having a bore therethrough, said connector pin extending through said connector pin bushing and said connector pin bushing being trapped between said door hinge plate and said pivot plate.

4. A refrigerator in accordance with claim 3 wherein said cabinet hinge plate further comprises a connector pin cut-out sized to at least partially receive said connector pin bushing.

5. A refrigerator in accordance with claim 1 wherein said pin stop comprises a flange which prevents one end of said pin stop from extending through said pin stop slot.

6. A refrigerator in accordance with claim 5 wherein said pin stop further comprises a bushing extending through said slot for minimizing friction between walls of said slot and said pin stop and for contacting the ends of said slot.

7. A refrigerator in accordance with claim 5 wherein said pin stop further comprises a threaded end sized to be inserted into said pin stop opening in said cabinet hinge plate and to threadedly engage said cabinet hinge plate.

8. A refrigerator in accordance with claim 7 wherein said pin stop further comprises a bushing having a first portion and a second portion, said bushing first portion extending through said slot for minimizing friction between walls of said slot and said pin stop and for contacting the ends of said slot, said bushing second portion having an end in contact with said cabinet hinge plate.

9. A door hinge and closure mechanism for being mounted to a refrigerator, the refrigerator including a cabinet having at least one access opening closed by a door, said hinge and closure mechanism configured to couple the door to the cabinet, said mechanism comprising:

a hinge unit comprising a door hinge plate configured to be mounted to the door and a cabinet hinge plate configured to be mounted to the cabinet, said door hinge plate configured to be coupled to said cabinet hinge plate, said cabinet hinge plate having a pin stop opening therein;

a closure unit for exerting a closure force on the door, said closure unit comprising a pivot plate configured to be coupled to said door hinge plate, said pivot plate having a pin stop slot therein, a spring movably configured to be coupled to said pivot plate, and a link for coupling said spring to said pivot plate; and a pin stop for assisting in stopping opening of the door, said pin stop configured to extend through said pin stop slot in said pivot plate and into said pin stop opening in said cabinet hinge plate.

10. A door hinge and closure mechanism in accordance with claim 9 wherein said hinge unit further comprises a pivot pin coupled to and extending from said door hinge plate, a pivot pin opening in said cabinet hinge plate, said pivot pin extending into said pivot pin opening in said cabinet hinge plate, and a pivot pin bushing having a bore therethrough, said pivot pin extending through said pivot pin bushing and said pivot pin bushing being trapped between said door hinge plate and said cabinet hinge plate.

11. A door hinge and closure mechanism in accordance with claim 9 wherein said hinge unit further comprises a connector pin coupled to and extending from said door hinge plate, a connector pin opening in said pivot plate, said connector pin extending through said connector pin opening in said pivot plate, and a connector pin bushing having a bore therethrough, said connector pin extending through said connector pin bushing and said connector pin bushing being trapped between said door hinge plate and said pivot plate.

12. A door hinge and closure mechanism in accordance with claim 11 wherein said cabinet hinge plate further comprises a connector pin cut-out sized to at least partially receive said connector pin bushing.

13. A door hinge and closure mechanism in accordance with claim 9 wherein said pin stop comprises a flange which prevents one end of said pin stop from extending through said pin stop slot.

14. A door hinge and closure mechanism in accordance with claim 13 wherein said pin stop further comprises a bushing extending through said slot for minimizing friction between walls of said slot and said pin stop and for contacting the ends of said slot.

15. A door hinge and closure mechanism in accordance with claim 13 wherein said pin stop further comprises a threaded end sized to be inserted into said pin stop opening in said cabinet hinge plate and to threadedly engage said cabinet hinge plate.

16. A door hinge and closure mechanism in accordance with claim 15 wherein said pin stop further comprises a bushing having a first portion and a second portion, said bushing first portion extending through said slot for minimizing friction between walls of said slot and said pin stop and for contacting the ends of said slot, said bushing second portion having an end in contact with said cabinet hinge plate.

17. A pin stop for a hinge and closure mechanism, including a pivot plate having a slot therein and a cabinet hinge plate having an opening therethrough, of a refrigerator, said pin stop comprising a flange which is capable of preventing one end of said pin stop from extending through the pivot plate slot and a bushing having a first portion and a second portion, said bushing first portion configured to extend through the slot for minimizing friction between walls of the slot and said pin stop and for contacting the ends of the slot, said bushing second portion having an end configured to be in contact with the cabinet hinge plate.

18. A pin stop in accordance with claim 17 wherein said pin stop further comprises a threaded end sized to be inserted into the opening in the cabinet hinge plate to threadedly engage the cabinet hinge plate.

* * * * *